US006089196A

United States Patent [19]

Izuo et al.

[11] Patent Number: 6,089,196

[45] **Date of Patent: *Jul. 18, 2000**

[54] CYLINDER HEAD HAVING A SOLENOID VALVE CONTROL DEVICE FOR OPERATING A VALVE OF AN INTERNAL COMBUSTION ENGINE

[75] Inventors: Takashi Izuo; Tatsuo Iida; Masahiko Asano, all of Toyota, Japan

[73] Assignee: Toyota Jidosha Kabushiki Kaisha, Aichi-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/055,181

[22] Filed: Apr. 3, 1998

[30] Foreign Application Priority Data

Apr. 4, 1997 [JP] Japan ..... 9-086666

[51] Int. Cl.[7] ..... F02F 1/24; F01L 9/04

[52] U.S. Cl. ..... 123/90.11; 123/41.82 R; 123/41.82 A; 123/193.5; 123/193.3

[58] Field of Search ..... 123/90.11, 90.15, 123/90.38, 41.82 R, 41.82 A, 193.5, 193.3

[56] References Cited

U.S. PATENT DOCUMENTS

| | | | |
|---|---|---|---|
| 3,983,852 | 10/1976 | Chatourel | 123/41.69 |
| 4,682,574 | 7/1987 | Kreuter | 123/90.11 |
| 4,688,523 | 8/1987 | Takahashi et al. | 123/41.32 |
| 4,988,074 | 1/1991 | Najmolhoda | 251/129.08 |
| 5,003,958 | 4/1991 | Yoneyama et al. | 123/635 |
| 5,035,637 | 7/1991 | Mathews et al. | 439/271 |
| 5,611,303 | 3/1997 | Izuo | 123/90.11 |

FOREIGN PATENT DOCUMENTS

| | | |
|---|---|---|
| 0798450 | 10/1997 | European Pat. Off. . |
| 3928066 | 2/1991 | Germany . |
| 296 07 963 U | 11/1996 | Germany . |
| 4-502191 | 4/1992 | Japan . |
| 5-340223 | 12/1993 | Japan . |
| 7-305612 | 11/1995 | Japan . |
| WO96/36795 | 11/1996 | WIPO . |

*Primary Examiner*—Weilun Lo
*Attorney, Agent, or Firm*—Kenyon & Kenyon

[57] ABSTRACT

A cylinder head having a solenoid valve control device for operating a valve of an internal combustion engine includes a valve element which constitutes one of an intake valve and an exhaust valve of the engine. An armature is connected to the valve element to operate the valve element. A first solenoid is provided above the armature to generate an electromagnetic force to attract the armature so that the valve element is moved to a valve-closing position. A second solenoid is provided below the armature to generate an electromagnetic force to attract the armature so that the valve element is moved to a valve-opening position. An upper head is provided on a top of the cylinder head, the upper head having a through hole at a given location in the upper head, the through hole having an upper open end and a lower open end in the upper head. The first solenoid is fitted to the upper open end of the through hole and the second solenoid is fitted to the lower open end of the through hole, so that the first solenoid and the second solenoid are held by the upper head at given positions relative to the armature.

11 Claims, 3 Drawing Sheets

CYLINDER HEAD HAVING A SOLENOID VALVE CONTROL DEVICE FOR OPERATING A VALVE OF AN INTERNAL COMBUSTION ENGINE

BACKGROUND OF THE INVENTION (1) Field of the Invention

The present invention generally relates to a cylinder head of an internal combustion engine, and more particularly to a cylinder head in which an intake valve and/or an exhaust valve of an internal combustion engine is operated by a solenoid valve control device.

(2) Description of the Related Art

Japanese Laid-Open Patent Application No. 7-305612 discloses a solenoid valve control device which electromagnetically operates an intake valve or an exhaust valve of an internal combustion engine.

The solenoid valve control device of the above-mentioned publication includes a valve element which serves as the intake valve or the exhaust valve of the engine. An armature of a magnetic material is connected to the valve element. In the solenoid valve control device, a first solenoid is provided above the armature and a second solenoid is provided below the armature. The solenoid valve control device controls one of the first solenoid and the second solenoid to generate an electromagnetic force such that the valve element is operated to open or close the intake valve or the exhaust valve of the engine.

In the conventional device of the above-mentioned publication, the valve element is accommodated in a cylinder head, and the first solenoid, the second solenoid, the armature and others are accommodated in an upper housing on the top of the cylinder head. However, the above-mentioned publication does not disclose a specific method of mounting the first solenoid, the second solenoid and the armature in the upper housing. The above-mentioned publication does not disclose specific, appropriate, relative positions of the first and second solenoids and the armature.

In the conventional device of the above-mentioned publication, the first solenoid and the second solenoid are completely supported by cylindrical members (which are provided in the upper housing) such that the relative positions of the first solenoid and the second solenoid to the armature are kept at appropriate positions. Since the cylindrical members are used in the conventional device, the outer diameters of the first solenoid and the second solenoid are required to be smaller than the inner diameters of the cylindrical members. Also, the outer diameter of the armature is required to be smaller than the inner diameters of the cylindrical members. In the conventional device of the above-mentioned publication, it is difficult to provide a large diameter for each of the first solenoid, the second solenoid and the armature because of the use of the cylindrical members.

Generally, a solenoid valve control device including a solenoid having a large diameter and an armature having a large diameter is required in order to exert a large electromagnetic force on the intake valve or the exhaust valve of the engine. However, the solenoid valve control device of the above-mentioned publication fails to provide an adequate structure to exert a large electromagnetic force on the intake valve or the exhaust valve of the engine.

Further, in the conventional device of the above-mentioned publication, the first solenoid and the second solenoid are completely supported by the cylindrical members in the upper housing, and an outer periphery of the first solenoid and an outer periphery of the second solenoid come into contact with the cylindrical member. It is difficult for the solenoid valve control device of the above-mentioned publication to bring the outer periphery of the first solenoid and the outer periphery of the second solenoid into contact with the upper housing.

During operation of the engine, heat is generated by the first solenoid and the second solenoid in the solenoid valve control device. It is desirable that a cylinder head having a solenoid valve control device provided therein effectively dissipates the heat from the first solenoid and the heat from the second solenoid. The larger the contact area of the first and second solenoids and the upper housing (or another member), the more effective the heat dissipation is. However, the solenoid valve control device of the above-mentioned publication fails to provide effective heat dissipation for a cylinder head having a solenoid valve control device provided therein.

SUMMARY OF THE INVENTION

An object of the present invention is to provide an improved cylinder head in which the above-described problems are eliminated.

Another object of the present invention is to provide a cylinder head having a solenoid valve control device for operating a valve of an internal combustion engine, which provides an adequate structure to exert a large electromagnetic force on the intake valve or the exhaust valve of the engine.

Still another object of the present invention is to provide a cylinder head having a solenoid valve control device for operating a valve of an internal combustion engine, which provides effective heat dissipation for the solenoid valve control device in the cylinder head.

The above-mentioned objects of the present invention are achieved by a cylinder head having a solenoid valve control device for operating a valve of an internal combustion engine, the cylinder head comprising: a valve element which constitutes one of an intake valve and an exhaust valve of the engine; an armature which is connected to the valve element to operate the valve element; a first solenoid which is provided above the armature to generate an electromagnetic force to attract the armature so that the valve element is moved to a valve-closing position; a second solenoid which is provided below the armature to generate an electromagnetic force to attract the armature so that the valve element is moved to a valve-opening position; and an upper head which is provided on a top of the cylinder head, the upper head having a through hole at a given location in the upper head, the through hole having an upper open end and a lower open end in the upper head, wherein the first solenoid is fitted to the upper open end of the through hole and the second solenoid is fitted to the lower open end of the through hole, so that the first solenoid and the second solenoid are held by the upper head at given positions relative to the armature.

In the cylinder head of the present invention, it is possible to produce a large electromagnetic force between the first solenoid and the armature and produce a large electromagnetic force between the second solenoid and the armature. The cylinder head of the present invention is effective in dissipating the heat from the first solenoid and the heat from the second solenoid. Further, in the cylinder head of the present invention, the mounting and the positioning of the first solenoid and the second solenoid in the cylinder head can be easily carried out, and it is possible to provide a good rate of production.

BRIEF DESCRIPTION OF THE DRAWINGS

The above and other objects, features and advantages of the present invention will be more apparent from the following detailed description when read in conjunction with the accompanying drawings in which.

DETAILED DESCRIPTION OF THE PREFERRED EMBODIMENT

A description will now be given of the preferred embodiment of the present invention with reference to the accompanying drawings.

Figure 1:
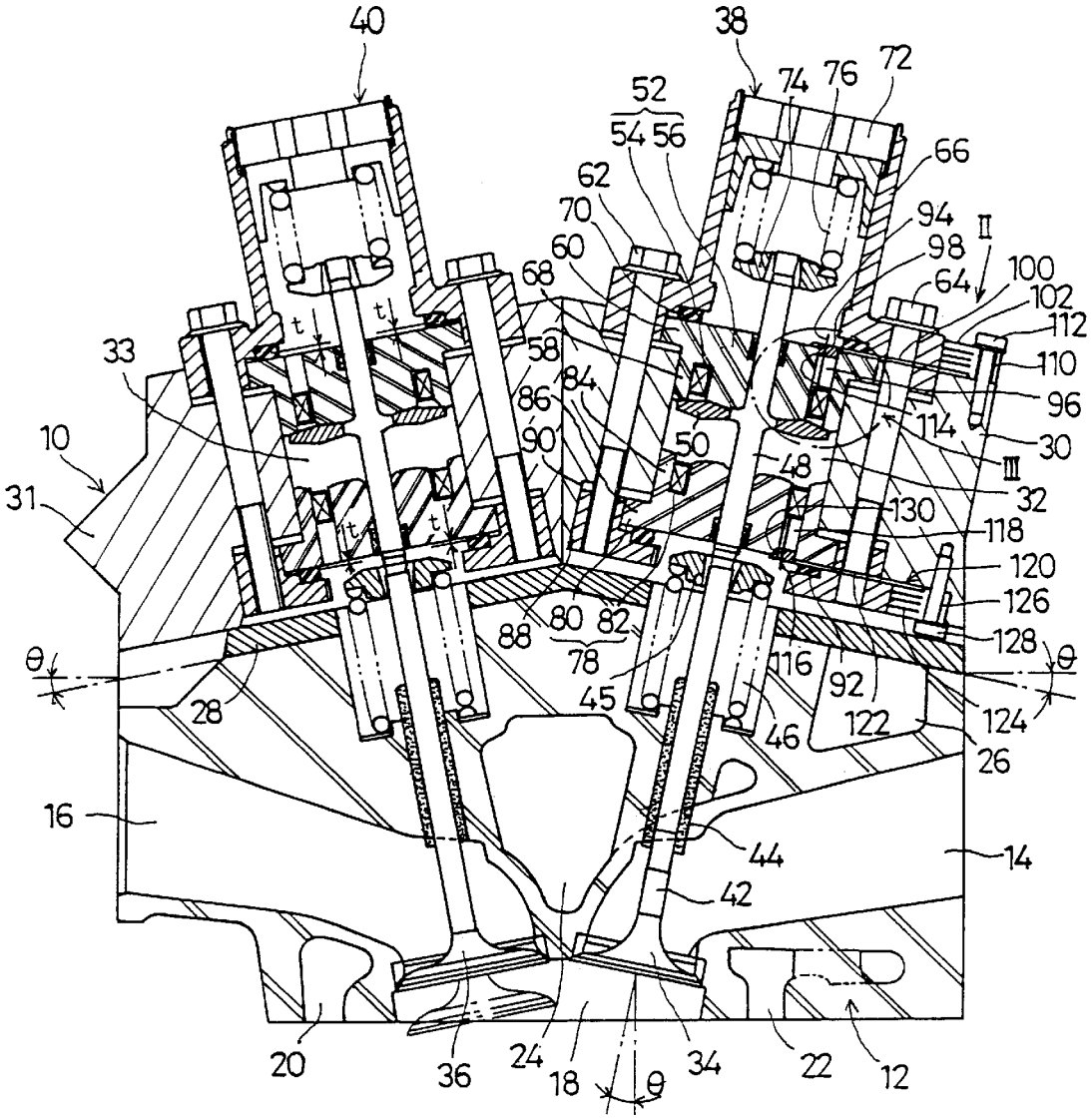
FIG. 1 is a cross-sectional view of an internal combustion engine to which one embodiment of a cylinder head of the present invention is applied.

FIG. 1 shows an internal combustion engine 10 to which one embodiment of a cylinder head of the present invention is applied.

As shown in FIG. 1, the internal combustion engine 10 includes a cylinder head 12. In the cylinder head 12, an intake port 14 and an exhaust port 16 are provided, and both the intake port 14 and the exhaust port 16 communicate with a combustion chamber 18. In the cylinder head 12, a plurality of cooling water passages 20, 22, 24 and 26 are provided.

In the cylinder head 12 of FIG. 1, cooling water flows through the cooling water passages 20, 22, 24 and 26 near the combustion chamber 18 and near the intake port 14. When the cylinder head 12 is produced by casting, the cooling water passages 20, 22, 24 and 26 are formed by placing cores in a casting mold. Only for the cooling water passages 24 and 26, after the cylinder head 12 is cast, machining is performed on the top of the cylinder head 12 to finish the cooling water passages 24 and 26.

In the cylinder head 12 of FIG. 1, a slanted surface is provided above the intake port 14 and a slanted surface is provided above the exhaust port 16. As indicated in FIG. 1, these slanted surfaces are at a given angle of "θ" to a horizontal direction, respectively. The directions of the slanted surfaces of the cylinder head 12 are in conformity with an inclination of an intake valve in the engine 10 and an inclination of an exhaust valve in the engine 10. A gasket 28 is provided on the slanted surfaces of the cylinder head 12. The gasket 28 is slanted and extends along the slanted surfaces of the cylinder head 12. The gasket 28 on the slanted surface above the exhaust port 16 is inclined downwardly to the left and the slope is at an angle "θ" to the horizontal direction. The gasket 28 on the slanted surface above the intake port 14 is inclined downwardly to the right and the slope is at the angle "θ" to the horizontal direction. The gasket 28 is a sealing member of the cylinder head 12, and an open end of the cooling water passage 26 in the cylinder head 12 is sealed with the gasket 28 to avoid leakage of the cooling water.

In the cylinder head 12 of FIG. 1, a right-hand upper head 30 is provided on the slanted surface of the intake port side, and a left-hand upper head 31 is provided on the slanted surface of the exhaust port side. The right-hand upper head 30 extends along the slanted surface and includes a through hole 32. The through hole 32 has an axial direction perpendicular to the slanted surface, and the axial direction of the through hole 32 is at the angle "θ" to a vertical direction. The left-hand upper head 31 extends along the slanted surface and includes a through hole 33. The through hole 33 has an axial direction perpendicular to the slanted surface, and the axial direction of the through hole 33 is at the angle "θ" to the vertical direction.

In the internal combustion engine 10 of FIG. 1, an intake valve 34 between the intake port 14 and the combustion chamber 18 is provided in conformity with the slanted surface, and an exhaust valve 36 between the exhaust port 16 and the combustion chamber 18 is provided in conformity with the slanted surface. The intake valve 34 has an axial direction inclined at the angle "θ" to the vertical direction. The exhaust valve 36 has an axial direction inclined at the angle "θ" to the vertical direction.

In the internal combustion engine 10 of FIG. 1, a first solenoid valve control device 38 which electromagnetically operates the intake valve 34, and a second solenoid valve control device 40 which electromagnetically operates the exhaust valve 36 are provided. The first solenoid valve control device 38 and the second solenoid valve control device 40 have a substantially identical construction, and only the construction of the first solenoid valve control device 38 will be described in the following. A description of the second solenoid valve control device 40 will be omitted.

In the engine 10 of FIG. 1, the first solenoid valve control device 38 includes a valve stem 42. The valve stem 42 is linked with the intake valve 34. The valve stem 42 extends along the axial direction of the intake valve 34 and is inclined at the angle "θ" to the vertical direction. A valve guide 44 is internally provided on the cylinder head 12, and the valve stem 42 is movably supported by the valve guide 44. A lower retainer 45 is connected to an upper end of the valve stem 42. A lower spring 46 is provided below the lower retainer 45 such that the lower spring 46 exerts an upward actuating force on the lower retainer 45 to lift the valve stem 42.

The upper end of the valve stem 42 is brought into contact with a plunger holder 48. The plunger holder 48 is made of a nonmagnetic material. An armature 50 is fixed to the plunger holder 48. The armature 50 is an annular member which is made of a magnetic material. Similar to the valve stem 42, the plunger holder 48 extends along the axial direction of the intake valve 34 and is inclined at the angle "θ" to the vertical direction.

In the first solenoid valve control device 38, a first solenoid 52 is provided above the armature 50. The first solenoid 52 includes a first solenoid coil 54 and a first core 56. The first core 56 is an annular member which is made of a magnetic material. The first core 56 includes a central opening on which the plunger holder 48 is movably held. The first core 56 includes a body portion 58 and a flange portion 60. The body portion 58 of the first core 56 is fitted to the through hole 32 of the right-hand upper head 30. The flange portion 60 has an outer diameter that is larger than an outer diameter of the body portion 58.

The right-hand upper head 30 includes an upper cap 66. The upper cap 66 is bolted to the right-hand upper head 30 by using bolts 62 and 64. The upper cap 66 is mounted on the right-hand upper head 30 to enclose the flange portion 60 of the first core 56. A spacer 68 is provided on the top of the right-hand upper head 30 such that the spacer 68 encompasses the periphery of the through hole 32. The spacer 68 is interposed between the flange portion 60 and the right-hand upper head 30 and interposed between the upper cap 66 and the right-hand upper head 30.

In the first solenoid valve control device 38, the upper cap 66 and the first core 56 are arranged such that a given clearance "t" is provided between the upper cap 66 and a top end surface of the first core 56. The first core 56 is movable relative to the upper cap 66 in the axial direction of the intake valve 34 within a range of the clearance "t".

A buffer member 70 is provided between the upper cap 66 and the top end surface of the first core 56. The buffer member 70 may be made of a silicon gel, a rubber or rubber-like material, or a spring. The buffer member 70 elastically connects the first solenoid 52 and the upper head 30. The buffer member 70 exerts a lower actuating force on the first core 56 to depress the first core 56 against the spacer 68. When no external force acts on the first core 56, the first core 56 is kept in contact with the spacer 68.

An adjuster bolt 72 is provided on the top of the upper cap 66. An upper retainer 74 is connected to an upper end of the plunger holder 48. An upper spring 76 is provided between the adjuster bolt 72 and the upper retainer 74 such that the upper spring 76 exerts a downward actuating force on the upper retainer 74 to lower the plunger holder 48.

A second solenoid 78 is provided below the armature 50. The second solenoid 78 includes a second solenoid coil 82 and a second core 80. The second core 80 is an annular member which is made of a magnetic material. The second core 80 includes a central opening on which the plunger holder 48 is movably held. The second core 80 includes a body portion 84 and a flange portion 86. The body portion 84 of the second core 80 is fitted to the through hole 32 of the right-hand upper head 30. The flange portion 86 has an outer diameter that is larger than an outer diameter of the body portion 84.

The right-hand upper head 30 includes a lower cap 88. The lower cap 88 is bolted to the bottom of the right-hand upper head 30 by using the bolts 62 and 64. The lower cap 88 is mounted on the right-hand upper head 30 to enclose the flange portion 86 of the second core 80. A spacer 90 is provided on the bottom of the right-hand upper head 30 such that the spacer 90 encompasses the periphery of the through hole 32. The spacer 90 is interposed between the flange portion 86 and the right-hand upper head 30 and is interposed between the lower cap 88 and the right-hand upper head 30.

In the first solenoid valve control device 38, the lower cap 88 and the second core 80 are arranged such that a given clearance "t" between the lower cap 88 and a top end surface of the second core 80 is provided. The second core 80 is movable relative to the lower cap 88 in the axial direction of the intake valve 34 within a range of the clearance "t".

A buffer member 92 is provided between the lower cap 88 and the top end surface of the second core 80. The buffer member 92 may be made of a silicon gel, a rubber or rubber-like material, or a spring. The buffer member 92 elastically connects the second solenoid 78 and the upper head 30. The buffer member 92 exerts an upward actuating force on the second core 80 to lift the second core 80 against the spacer 90. When no external force acts on the second core 80, the second core 80 is kept in contact with the spacer 90.

In the first solenoid valve control device 38, a neutral position of the plunger holder 48 is adjustable by tightening or loosening the adjuster bolt 72. In the present embodiment, the adjuster bolt 72 is preset such that the neutral position of the plunger holder 48 is placed at a middle point between the first solenoid coil 52 and the second solenoid coil 78.

First lead wires 94 are electrically connected to ends of turns of insulated wire of the first solenoid coil 54. A wiring hole 96 is provided in the first core 56, and the first lead wires 94 from the first solenoid coil 54 are passed through the wiring hole 96 such that upper ends of the first lead wires 94 are provided above the top of the first core 56.

In the cylinder head 12 of the present embodiment, the first solenoid valve control device 38 includes a first conductive member 98. The first lead wires 94 from the wiring hole 96 are electrically connected to an external control device by using the first conductive member 98.

Figure 2:
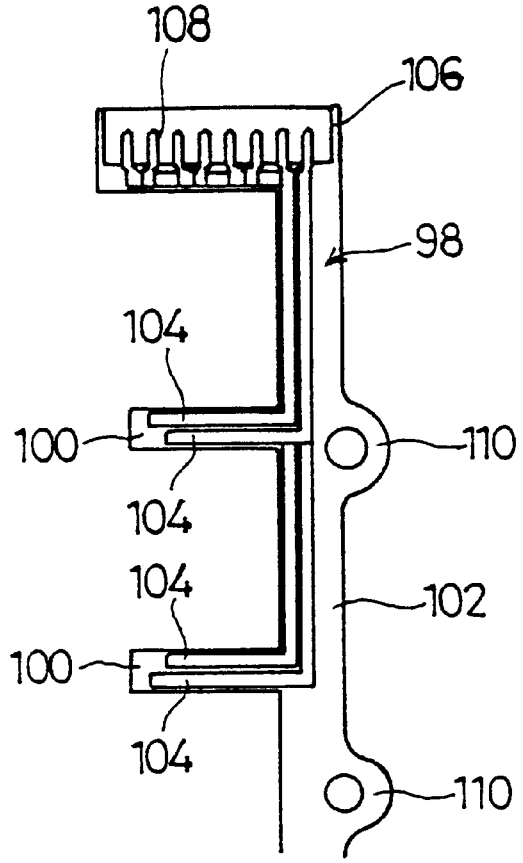
FIG. 2 is a top view of a first conductive member of the cylinder head when viewed from a direction indicated by an arrow "II" in FIG. 1.

FIG. 2 shows the first conductive member 98 of the cylinder head 12 when viewed from the direction indicated by the arrow "II" in FIG. 1.

As shown in FIG. 2, the first conductive member 98 is provided at a side portion on the top of the right-hand upper head 30. The first conductive member 98 generally has a trunk portion 102 with a plurality of branch portions 100. The plurality of branch portions 100 in the first conductive member 98 are provided so as to correspond in number to the total number of the first solenoid valve control devices 38 provided in the engine 10. The branch portions 100 are overlapped with one another in a vertical direction and mutually insulated so as to avoid interference with the branch portions 100.

In each of the branch portions 100 of the first conductive member 98, two first conductors 104 are provided. The two first conductors 104 of one of the branch portions 100 are electrically connected to the ends of the turns of the insulated wire of one of the first solenoid coils 54 for the first solenoid valve control devices 38 of the engine 10. A connector 106 is provided at one end of the trunk portion 102. All the first conductors 104 of the first conductive member 98 extend through the trunk portion 102 to the connector 106. The connector 106 has a plurality of terminals 108 which are electrically connected to the first conductors 104 of the first conductive member 98 respectively. The first conductors 104 on the branch portions 100 are individually resin-molded to avoid short-circuiting of the first conductors 104 in the first conductive member 98.

In the trunk portion 102 of the first conductive member 98, a plurality of bolt holes 110 are provided. As shown in FIG. 1, the first conductive member 98 is bolted to the right-hand upper head 30 by fastening a plurality of bolts 112 to the bolt holes 110 of the trunk portion 102. The upper cap 66 is provided with grooves, and the branch portions 100 of the first conductive member 98 are placed into the grooves of the upper cap 66. The branch portions 100 from the trunk portion 102 are passed through the grooves of the upper cap 66 to the first conductors 94.

Figure 3:
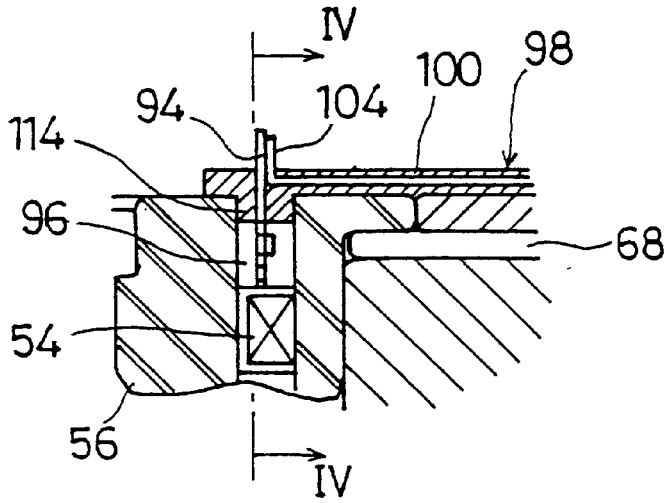
FIG. 3 is an enlarged view of a portion of the cylinder head indicated by an arrow "III" in FIG. 1.
Figure 4:
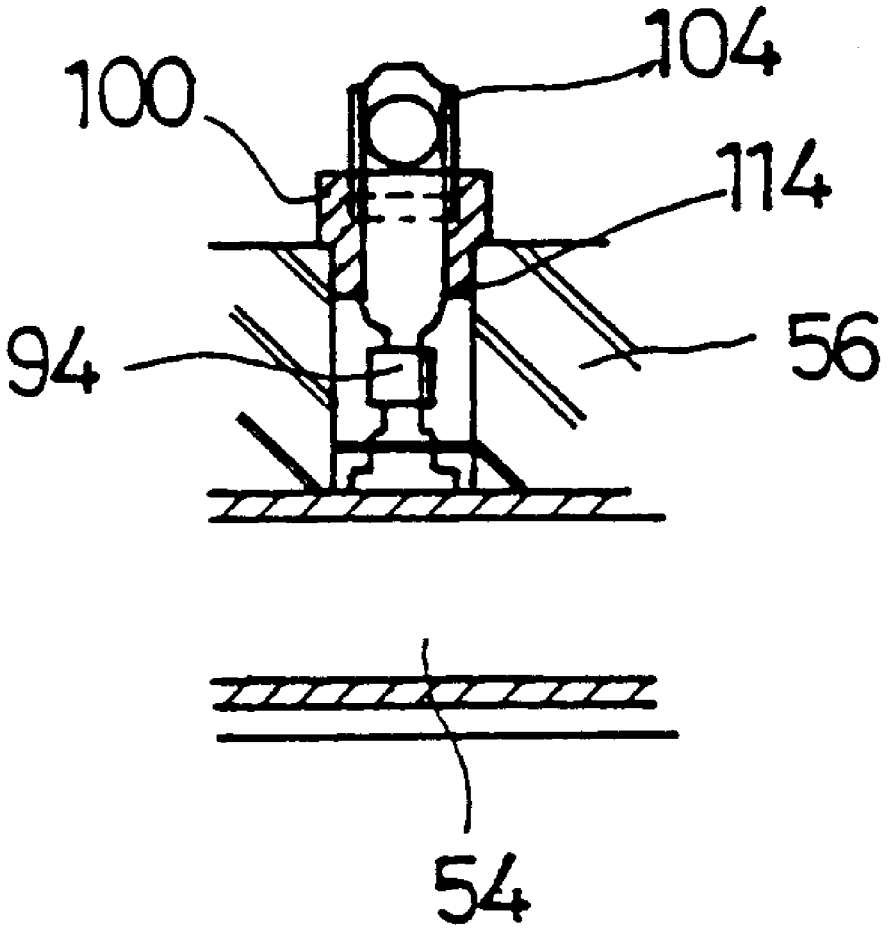
FIG. 4 is a cross-sectional view of a first core of the cylinder head taken along a line IV—IV indicated in FIG. 3.

FIG. 3 is an enlarged view of a portion of the cylinder head 12 indicated by an arrow "III" in FIG. 1. FIG. 4 is a cross-sectional view of the first core 56 of the cylinder head 12 taken along a line IV—IV indicated in FIG. 3.

As shown in FIG. 3 and FIG. 4, a downward projecting portion 114 is provided in one of the branch portions 100 of the first conductive member 98. The downward projecting portion 114 is fitted into the wiring hole 96 of the first core 56. The downward projecting portion 114 has a vertically extending opening. The first lead wires 94 from the first solenoid coil 54 are passed through the opening of the downward projecting portion 114. The first lead wires 94 are bonded to the first conductors 104 of the branch portion 100 above the downward projecting portion 114. In the above-described structure, relative positions between the first conductors 104 of the branch portions 100 and the first core 56 of the first solenoid 52 are restricted by the downward projecting portion 114.

As shown in FIG. 1, second lead wires 116 are electrically connected to ends of turns of insulated wire of the second solenoid coil 82. A wiring hole 118 is provided in the second core 80, and the second lead wires 116 from the second solenoid coil 82 are passed through the wiring hole 118 such that lower ends of the second lead wires 116 are provided below the bottom of the second core 80. In the cylinder head 12 of the present embodiment, the first solenoid valve control device 38 includes a second conductive member 120. The second lead wires 116 from the wiring hole 118 are electrically connected to an external control device by using the second conductive member 120. The second conductive member 120 is provided at a side portion on the bottom of the right-hand upper head 30.

Similar to the first conductive member 98, the second conductive member 120 generally has a trunk portion 124 with a plurality of branch portions 122. The plurality of branch portions 122 in the second conductive member 120 are provided so as to correspond in number to the total number of the first solenoid valve control devices 38 provided in the engine 10. The branch portions 122 are overlapped with one another in a vertical direction and mutually insulated so as to avoid interference with the branch portions 122.

In the trunk portion 124 of the second conductive member 120, a plurality of bolt holes 126 are provided. The second conductive member 120 is bolted to the right-hand upper head 30 by fastening a plurality of bolts 128 to the bolt holes 126 of the trunk portion 124.

In each of the branch portions 122 of the second conductive member 120, two second conductors (not shown) are provided. The two second conductors of one of the branch portions 122 are electrically connected to the ends of the turns of the insulated wire of one of the second solenoid coils 82 for the first solenoid valve control devices 38 of the engine 10. A connector (not shown) is provided at one end of the trunk portion 124. All the second conductors of the second conductive member 120 extend through the trunk portion 124 to this connector. Similar to the connector 106, this connector has a plurality of terminals (not shown) which are electrically connected to the second conductors of the second conductive member 120 respectively. The second conductors on the branch portion 122 are individually resin-molded to avoid short-circuiting of the second conductors in the second conductive member 120.

Further, in one of the branch portions 122 of the second conductive member 120, an upward projecting portion 130 is provided. The upward projecting portion 130 is fitted into the wiring hole 118 of the second core 80. The upward projecting portion 130 has a vertically extending opening. The second lead wires 116 from the second solenoid coil 82 are passed through the opening of the upward projecting portion 130. The second lead wires 116 are bonded to the second conductors of the branch portion 122 below the upward projecting portion 130. In the above-described structure, relative positions between the second conductors of the branch portions 122 and the second core 80 of the second solenoid 78 are restricted by the upward projecting portion 130.

Next, a description will be given of an operation of the first solenoid valve control device 38 of the present embodiment.

When no current is supplied to the first solenoid 54 and the second solenoid 78, the plunger holder 48 of the first solenoid valve control device 38 is held at the neutral position. When the plunger holder 48 is placed at the neutral position, the intake valve 34 is held at a middle position between a fully open position and a fully closed position.

When an exciting current flows through the first solenoid coil 54, the first solenoid 52 generates an electromagnetic force to attract the armature 50. As a result, the intake valve 34 is moved up together with the armature 50. The armature 50 is continuously moved up until the armature 50 is brought into contact with the first core 56. The intake valve 34 is continuously moved up until the intake valve 34 reaches the fully closed position. Accordingly, when the exciting current flows through the first solenoid coil 54, the armature 50 is brought into contact with the first core 56 and the intake valve 34 is placed at the fully closed position to fully shut the intake port 14.

After the intake valve 34 is placed at the fully closed position, the exciting current having been supplied to the first solenoid coil 54 is cut off. The electromagnetic force acting on the armature 50 is eliminated. As a result, the intake valve 34 starts being moved down together with the armature 50 due to the downward actuating force of the upper spring 76. Then, an exciting current flows through the second solenoid coil 82, and the second solenoid 78 generates an electromagnetic force to attract the armature 50. The intake valve 34 is moved down together with the armature 50. The armature 50 is continuously moved down until the armature 50 is brought into contact with the second core 80. The intake valve 34 is continuously moved down until the intake valve 34 reaches the fully open position. Accordingly, when the exciting current flows through the second solenoid coil 82, the armature 50 is brought into contact with the second core 80 and the intake valve 34 is placed at the fully open position to fully open the intake port 14.

According to the first solenoid valve control device 38 of the above-described embodiment, the intake valve 34 can be operated such that the intake valve 34 is placed at the fully closed position by supplying the exciting current to the first solenoid coil 54, and it is placed at the fully open position by supplying the exciting current to the second solenoid coil 82. Therefore, according to the first solenoid valve control device 38, the intake valve 34 can be repeatedly opened and closed by alternately supplying the exciting current to one of the first solenoid coil 54 and the second solenoid coil 82.

In the first solenoid valve control device 38 of the above-described embodiment, the first core 56 and the second core 80 are simply fitted into the upper open end and the lower open end of the through hole 32 of the right-hand upper head 30, respectively. It is possible for the cylinder head 12 having the first solenoid valve control device 38 to provide a large diameter for each of the body portion 58 of the first core 54, the body portion 84 of the second core 80, and the armature 50. Therefore, the cylinder head 12 having the first solenoid valve control device 38 is effective in producing a large electromagnetic force between the first solenoid 52 and the armature 50 and a large electromagnetic force between the second solenoid 78 and the armature 50.

Further, in the first solenoid valve control device 38 of the above-described embodiment, the whole side wall of the body portion 58 of the first core 56 is brought into contact with the internal wall of the through hole 32 of the right-hand upper head 30. The top surface of the flange portion 60 of the first core 56 is brought into contact with the spacer 68, and the side wall of the flange portion 60 of the first core 56 is brought into contact with the upper cap 66. Similarly, the whole side wall of the body portion 84 of the second core 80 is brought into contact with the internal wall of the through hole 32 of the right-hand upper head 30. The bottom surface of the flange portion 86 of the second core 80 is brought into contact with the spacer 90, and the side wall of the flange portion 86 of the second core 80 is brought into contact with the lower cap 88.

The first solenoid coil 54 generates heat when the exciting current flows through the first solenoid coil 54. As described above, in the first solenoid valve control device 38, the contact area of the body portion 58 of the first core 56 and the right-hand upper head 30 can be relatively large. The contact area of the flange portion 60 of the first core 56 and the spacer 68 can be relatively large, and the contact area of the flange portion 60 of the first core 56 and the upper cap 66 can be relatively large. Therefore, it is possible for the cylinder head 12 having the first solenoid valve control device 38 to effectively dissipate heat from the first solenoid coil 54.

The second solenoid coil 82 generates heat when the exciting current flows through the second solenoid coil 82. As described above, in the first solenoid valve control device 38, the contact area of the body portion 84 of the second core 80 and the right-hand upper head 30 can be relatively large. The contact area of the flange portion 86 of the second core 80 and the spacer 90 can be relatively large, and the contact area of the flange portion 86 of the second core 80 and the lower cap 88 can be relatively large. Therefore, it is possible for the cylinder head 12 having the first solenoid valve control device 38 to effectively dissipate heat from the second solenoid coil 82.

Further, in the first solenoid valve control device 38 of the above-described embodiment, the first core 56 and the second core 80 are simply fitted into the upper open end and the lower open end of the through hole 32 of the right-hand upper head 30. The mounting and the positioning of the first solenoid 52 and the second solenoid 78 in the cylinder head 12 can be easily carried out, and it is possible for the cylinder head 12 having the first solenoid valve control device 38 to be easily and efficiently produced.

Accordingly, in the cylinder head 12 having the first solenoid valve control device 38 of the above-described embodiment: (1) it is possible to produce a large electromagnetic force between the first solenoid and the armature and produce a large electromagnetic force between the second solenoid and the armature; (2) the cylinder head of the above-described embodiment is effective in dissipating heat from the first solenoid and the heat from the second solenoid; and (3) the mounting and the positioning of the first solenoid and the second solenoid in the cylinder head can be easily carried out, and it is possible to be easily and efficiently produced.

In the first solenoid valve control device 38 of the above-described embodiment, the buffer member 70 is provided between the first core 56 and the upper cap 66, and the buffer member 92 is provided between the second core 80 and the lower cap 88. Therefore, the first core 56 can be slightly displaced relative to the upper cap 66 because of the elasticity of the buffer member 70, and the second core 80 can be slightly displaced relative to the lower cap 88 because of the elasticity of the buffer member 92.

During operation of the engine 10, the armature 50 in the first solenoid valve control device 38 repeatedly touches one of the first core 56 and the second core 80, and a contact sound is generated each time the armature 50 touches one of the first core 56 and the second core 80. In the above-described embodiment, the first core 56 and the second core 80 can be displaced because of the elasticity of the buffer members 70 and 92 when they are hit by the armature 50, and it is possible to reduce the level of the contact sound generated by the first solenoid valve control device 30.

In the above-described embodiment, the first solenoid valve control device 38 includes the first solenoid 52 and the second solenoid 78. It is necessary to provide both the wiring of the first solenoid 52 and the wiring of the second solenoid 78 in the cylinder head 12. As described above, the first core 56 and the second core 80 are simply fitted into the upper open end and the lower open end of the through hole 32 of the right-hand upper head 30. The mounting and the positioning of the first solenoid 52 and the second solenoid 78 in the cylinder head 12 can be easily carried out, and it is possible for the cylinder head 12 having the first solenoid valve control device 38 to be easily produced. It is not necessary that a complicated routing procedure be performed to provide the wiring of the first solenoid 52 and the wiring of the second solenoid 78 in the cylinder head 12.

In the above-described embodiment, the first conductive member 98 includes the downward projecting portion 114 which is fitted into the wiring hole 96 of the first core 56. The second conductive member 120 includes the upward projecting portion 130 which is fitted into the wiring hole 118 of the second core 80. During operation of the engine 10, the first solenoid valve control device 38 is subjected to vibration due to the operation of the engine. However, the cylinder head 12 having the first solenoid valve control device 38 can prevent the relative positions of the first core 56 and the first conductive member 98 in the vicinity of the downward projecting portion 114 from considerable deviation. Also, the cylinder head 12 having the first solenoid valve control device 38 can prevent the relative positions of the second core 80 and the second conductive member 120 in the vicinity of the upward projecting portion 130 from considerable deviation.

In the above-described embodiment, the first lead wires 94 from the first solenoid coil 54 are bonded to the first conductors 104 of the first conductive member 98 above the downward projecting portion 114. Since the relative positions of the first core 56 and the first conductive member 98 in the vicinity of the downward projecting portion 114 do not considerably deviate, the bonded portions are not subjected to stress concentration. Also, the second lead wires 116 from the second solenoid coil 82 are bonded to the second conductors of the second conductive member 120 below the upward projecting portion 130. Since the relative positions of the second core 80 and the second conductive member 120 in the vicinity of the upward projecting portion 130 do not considerably deviate, the bonded portions are not subjected to stress concentration. It is possible for the cylinder head 12 having the first solenoid valve control device 38 to provide adequate reliability for both the wiring of the first solenoid 52 and the wiring of the second solenoid 78.

In the above-described embodiment, the internal combustion engine 10 has the intake valve 34 extending in the axial direction which is inclined at a given angle "θ" to the vertical direction and the exhaust valve 36 extending in the axial direction which is inclined at a given angle "θ" to the horizontal direction. In this case, it is necessary to arrange the first solenoid valve control device 38 and the second solenoid valve control device 40 in the cylinder head 12 such that the axial directions of the control devices 38 and 40 are in conformity with the axial directions of the intake valve 34 and the exhaust valve 36.

In the above-described embodiment, the cylinder head 12 includes the slanted surface provided above the intake port 14 and the slanted surface provided above the exhaust port 16. The slanted surfaces are at the given angle "θ" to the horizontal direction, respectively, which is in conformity with the inclination of the intake valve 34 and the inclination of the exhaust valve 36 in the engine 10.

Therefore, according to the above-described embodiment, the right-hand upper head 30 having the first solenoid valve control device 38 installed therein and the left-hand upper head 31 having the second solenoid valve control device 40 installed therein can be simply mounted on the slanted surfaces of the cylinder head 12. It is not necessary to perform an adjustment for correcting the positions of the first solenoid valve control device 38 and the second solenoid valve control device 40. It is possible for the cylinder head of the above-described embodiment to be easily produced.

In the above-described embodiment, when the cylinder head 12 is produced by casting, the cooling water passages 20, 22, 24 and 26 are formed by placing the cores in the casting mold. Only for the cooling water passages 24 and 26, after the cylinder head 12 is cast, machining is performed on the top of the cylinder head 12 to finish the cooling water passages 24 and 26. Although the configuration of the cooling water passages 20 and 22 is limited due to the casting using the cores, the configuration of the cooling water passages 24 and 26 is not limited. It is possible to be flexible in providing the configuration of the cooling water passages 24 and 26 in the cylinder head 12.

In the above-described embodiment, both the intake valve 34 and the exhaust valve 36 are operated by the first solenoid valve control device 38 and the second solenoid valve control device 40. However, the present invention is not limited to the above-described embodiment. The cylinder head of the present invention may include a solenoid valve control device which operates at least one of the intake valve and the exhaust valve of the engine.

In the above-described embodiment, the first solenoid 52 is elastically connected to the upper head 30 by the buffer member 70 and the second solenoid 78 is elastically connected to the upper head 30 by the buffer member 92. However, the present invention is not limited to the above-described embodiment. The elastic connections may be provided by adjusting the degree to fasten the bolts 62 and 64.

Further, the present invention is not limited to the above-described embodiment, and variations and modifications may be made without departing from the present invention.

What is claimed is:

1. A cylinder head assembly having mounted therein a solenoid valve control device for operating a valve of an internal combustion engine, the cylinder head assembly comprising:

a lower cylinder head;

an upper cylinder head mounted atop the lower cylinder head, wherein the upper cylinder head has a through hole extending therethrough from an upper open end to a lower open end;

a valve element extending substantially along an axis, the valve element constituting one of an intake valve and an exhaust valve of the engine;

an armature supported within the upper cylinder head, the armature being connected to the valve element for operating the valve element between a valve-open position and a valve-closed position;

a first solenoid mounted in the upper open end above the armature so that a line extending through the armature parallel to the axis passes through the first solenoid, the first solenoid generating a valve-closing electromagnetic force to attract the armature into the valve-closed position, wherein the first solenoid includes a flange portion having a diameter larger than a diameter of the through hole; and a second solenoid mounted in the lower open end below the armature so that the line extending through the armature parallel to the axis passes through the second solenoid, the second solenoid generating a valve-opening electromagnetic force to attract the armature into the valve-open position, wherein the second solenoid includes a flange portion at a lower end thereof, the flange portion having a diameter larger than the diameter of the through hole, contact between the flange portions of the first and second solenoids and the upper cylinder head adjacent to the through hole maintaining the first and second solenoids in given positions relative to the armature.

2. The cylinder head assembly according to claim 1, further comprising:

a first buffer member elastically connecting the first solenoid to the upper head; and a second buffer member elastically connecting the second solenoid to the upper head.

3. The cylinder head according to claim 1, further comprising:

first lead wires electrically connected to the first solenoid; and second lead wires electrically connected to the second solenoid, wherein the first lead wires are provided at the upper open end of the through hole of the upper head and the second lead wires are provided at the lower open end of the through hole of the upper head.

4. The cylinder head assembly according to claim 3, further comprising a first conductive member provided at a side portion on a top of the upper head, the first conductive member having first conductors electrically connected to the first lead wires, the first conductors being individually molded to avoid short-circuiting of the first conductors in the first conductive member.

5. The cylinder head according to claim 4, wherein the first conductive member has a downward projecting portion connected to the first solenoid, the downward projecting portion having an opening through which the first lead wires from the first solenoid are passed, the downward projecting portion restricting relative positions between the molded first conductors and the first solenoid.

6. The cylinder head according to claim 4, further comprising a second conductive member provided at a side portion on a bottom of the upper head, the second conductive member having second conductors electrically connected to the second lead wires, the second conductors being individually molded to avoid short-circuiting of the second conductors in the second conductive member.

7. The cylinder head according to claim 6, wherein the second conductive member has an upward projecting portion connected to the second solenoid, the upward projecting portion having an opening through which the second lead wires from the second solenoid are passed, the upward projecting portion restricting relative positions between the molded second conductors and the second solenoid.

8. The cylinder head assembly according to claim 1, wherein the valve element has an axial direction inclined at a given angle to a vertical direction, and wherein the cylinder head has a slanted surface on which the upper head is provided, the slanted surface being perpendicular to the axial direction of the valve element.

9. The cylinder head assembly according to claim 1, wherein the cylinder head includes a slanted surface and a cooling water passage, the upper head being provided on the slanted surface, and wherein the cylinder head further includes a sealing member provided between the upper head and the slanted surface of the cylinder head for sealing an open end of the cooling water passage to avoid leakage of cooling water.

10. The cylinder head according to claim 2, wherein the upper head includes an upper cap and a lower cap, the upper cap being secured to a top of the upper head via the first buffer member such that the first solenoid and the upper head are elastically connected by the first buffer member, and the lower cap being secured to a bottom of the upper head via the second buffer member such that the second solenoid and the upper head are elastically connected by the second buffer member.

11. The cylinder head assembly according to claim 1, wherein the first solenoid is mounted in the through hole above the armature via the open upper end of the upper cylinder head, and wherein the second solenoid is mounted in the through hole below the armature via the lower open end.

* * * * *